United States Patent [19]

Tudek

[11] Patent Number: 4,739,892

[45] Date of Patent: Apr. 26, 1988

[54] CONTAINER CAP ASSEMBLY

[75] Inventor: Arthur L. Tudek, Glassport, Pa.

[73] Assignee: William J. Ruano, Pittsburgh, Pa. ; a part interest

[21] Appl. No.: 46,678

[22] Filed: May 7, 1987

[51] Int. Cl.[4] ..... B65D 41/34

[52] U.S. Cl. ..... 215/232; 215/257

[58] Field of Search ..... 215/232, 231, 257, 295, 215/296, 298, 299, 255; 220/258

[56] References Cited

U.S. PATENT DOCUMENTS

| | | | |
|---|---|---|---|
| 2,193,381 | 3/1940 | Prough | 215/299 X |
| 2,222,042 | 11/1940 | Nitardy et al. | 215/231 |
| 2,925,188 | 2/1960 | Grumbles | 215/232 |

FOREIGN PATENT DOCUMENTS

| | | | |
|---|---|---|---|
| 2625942 | 12/1977 | Fed. Rep. of Germany | 215/296 |

*Primary Examiner*—Donald F. Norton

*Attorney, Agent, or Firm*—William J. Ruano

[57] ABSTRACT

A container cap assembly for containers holding motor oil, anti-freeze or other liquids to be poured into receptacles, in the engine assembly. An air-tight seal is adhesively attached to close the opening of the container with a string attached to the top of the seal. After the container is tilted for pouring the other end of the string is pulled to allow the liquid to pour out of the container. Such other end may be attached to the screw cap of the container to facilitate pulling and breaking the seal.

5 Claims, 1 Drawing Sheet

4
5
3
2
8

4
5
7
3
2

4
5
3
2
1

CONTAINER CAP ASSEMBLY

This invention relates to a container cap assembly for all hand-held containers that have inner top opening seals. It is most significant for a container for motol oil, antifreeze, windshield washer fluid and other liquid for the purpose of preventing spillage as the container is being tilted for pouring into a vehicle oil inlet or other liquid reservoir. It is also ideal for simply removing the membrane seal from these containers by means of a built-in seal remover.

BACKGROUND OF THE INVENTION

A good illustration for the merits of this invention is the containers that used by motorists. With the continuing disappearence of the full-service stations, motorists are now forced to personally add the required fluids to their vehicles, especially oil. To make it easier to add oil, manufacturers have designed containers with long necks or spouts at the end of which a sealed cap is screwed on. When the cap is unscrewed from such container and the container is tilted so that its opening is moved to the inlet of the oil reservoir for supplying additional oil, spillage usually occurs because of tight quarters or because of difficulty of aiming the poured liquid stream; and even when clearance exist, during the course of the tilt of a full container of liquid, spillage often occurs before the spout contacts the inlet of the reservoir. Another problem that exists with hand-held containers that have inner top opening seals, be it liquid or solid contents, is the user after taking off the cap, must now remove the membrance seal, either by poking a finger through the said seal or getting a utensil and puncture the seal to remove it.

SUMMARY OF THE INVENTION

An object of the present invention is to provide a cap construction which overcomes the above-mentioned problems and whereby a hand-held container with an inner membrane seal can be broken and lifted off by removing the cap from the container by grasping the cap and pulling the said seal off because a string is attached to both ends.

A more specific object of the invention is to provide a cap construction for a hand-held container for liquids with an inner membrane seal secured at the neck opening that enables the container to be tilted or inverted up to 180° into a filler tube without spilling a drop. To make the fluids flow, the inner seal, that is attached to a string, is broken by pulling the cap, which the other end of the string is attached or tearing it.

DETAILED DESCRIPTION OF PREFERRED EMBODIMENTS

Figure 3:
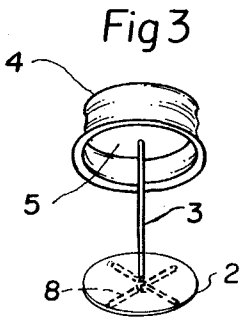
FIG. 3 is a further modification including a spider to facilitate tearing open of the seal on the bottle opening.
Figure 2:
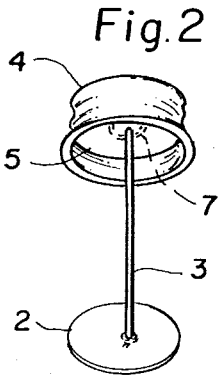
FIG. 2 shows a modification wherein the bottle cap is attached to the end of the string.
Figure 1:
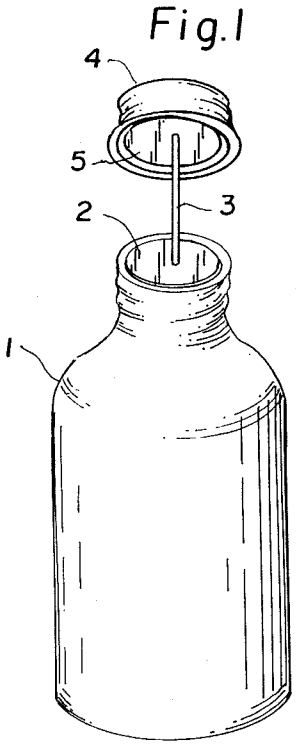
FIG. 1 shows the entire assembly of a bottle cap embodying the present invention.

FIG. 1 shows the entire assembly of a container cap embodying the present invention and FIGS. 2 and 3 show modifications.

Referring more particularly to the drawing, number 1 denotes a container of any construction, preferably of plastic material having a neck, the upper end of which is sealed by a disc shaped seal 2 either of aluminum or other metal foil or paper or plastic material, the periphery of which is adhesively sealed to the periphery of the top of the neck portion of the container.

Attached to seal 2 preferably but not necessarily at the edge thereof, is one end of a string 3 which can be fitted inside of a cap 4 such as a screwthreaded cap which is screw threadedly secured to the neck of the container.

The free end of the string is preferably attached or tied to the inner disc shaped gasket 5 fitted and glued to secure it inside of cap 4.

In operation, for an example, when it is desired to add or fill oil into a reservoir of a vehicle, the user unscrews or lifts the cap 4 from the neck of the container 1 and then moves the container 1 and tilting and placing the neck into the filler tube or to the desired angular position for pouring, the free end of the spring is pulled. By pulling the cap 4 so as to pull and tear off seal 2 from the container top, permits and results the oil to flow gravitational freely into the filler tube without any leakage.

For containers with no need for gravitational feed, the user unscrews or lifts off the cap 4, grasps the cap with one hand, holds the container 1 with the other hand and then pulls on the cap 4. This results in taking up the slack of the string 3 to put lifting pressure on the seal 2 to remove it from the container.

After using the product, the user may reseal it by placing the string along with the seal inside of the cap and rescrew or resnap the cap back onto the container.

FIG. 2 shows a modification wherein the free end of the string is attached to a ring 7 which normally fits inside the cap 4 and the other end is attached to the edge portion of seal 2 to more progressively remove the seal. Thus after the bottle is tiled while still having seal 2 in place, the ring may be pulled so as to pull off the disc-shaped seal from the bottle and thereby allow the liquid in the bottle to flow freely into the spout. The ring 7 and string3 are normally contained inside cap 4.

A small tab (not shown) may be used instead of the ring to more easily pull the free end of the string.

FIG. 3 shows a further modification wherein a spider 8 of metal or strong plastic such as nylon, is attached to the bottom surface of seal 2 of metal, plastic or paper foil so as to more easily tear seal 2 radially when the string is pulled in situations where the adhesive of seal 2 is difficult to break.

While the invention is described as being useful for refilling oil or anti-freeze tanks in automobiles, it may be used on bottles containing liquid for other uses where the bottle must be tilted appreciably to reach the intended receptical to be filled.

A piece of string about 4" long is attached to the cap 4 by threading the string through a center hole of the cap gasket 5. It is then knotted. Now the gasket with the string is glued to the inside of the cap, securing it. The container 1 is made ready by applying glue to the edge or rim of the neck's extremity. A seal cap 2 is then placed on the opening. Then a drop of epoxy glue is placed at the center of the seal cap to secure the other end of the string. After drying, the cap 4 can be screwed on for a finished product.

Another way, possibly better, would be after securing one end of the string 3 to the cap as previously described, the one end of the string would be secured to the center of the cap seal 5 with epoxy and then after drying, the attached cap seal would be loosely placed into the cap. Then glue could be applied to the rim of the container 1. Now the complete cap seal 5 with cap 4 can be screwed onto the container 1, thus giving the seal a better adherence by screwing pressure of the cap.

Thus it will be seen that I have provided a highly useful and efficient cap closure assembly for enabling the motorist to easily fill his oil tank or cooling system without spilling a drop of the liquid in the course of tilting the neck of the bottle to the filling spout of the oil supply or cooling liquid supply, thereby avoiding spillage on automotive parts or on the motorist and conserving oil, anti-freeze or other liquid.

While I have illustrated and described several embodiments of my invention, it will be understood that these are by way of illustration only and that various changes and modifications may be contemplated in my invention and within the scope of the following claims:

I claim:

1. A container for contents, having an opening, an air tight seal adhesively attached to said opening, and an elongated string having one end attached to the center of said seal, whereby when the container is tilted, the string may be pulled to break said seal.

2. A container as recited in claim 1 together with a container cap having an inner wafer-like portion which is adhesively secured to said cap to the center of which the other end of said string is attached.

3. A container recited in claim 1 wherein said seal is of discshape for sealing the opening of said container and said string being elongated having one end attached to said seal, and a closure cap having the other end of string attached to it. whereby the container may be tilted to have the first mentioned seal positioned to the lowest point of gravity with respect to the container, and whereby holding and pulling the said cap thus taking up the slack of the string to put pulling pressure on the first mentioned seal will tear it away from the said opening to allow fluids to flow.

4. A container for holding either liquids or solids, a seal of a disc-shape for sealing the opening of said container and a long string having one end attached to the center of said seal, and a closure cap having the other end of said string attached, whereby the container can be handheld securely, and whereby holding and pulling the said cap with other hand results in removing the said seal from said container.

5. A container for holding either liquids or solids, a seal of a disc-shape for sealing the opening of said container, a spider attached to the bottom of the said seal and a string which is about four inches long having one end attached to the center of said spider, and a closure cap to the center of which the other end of said string is attached, whereby the container can be hand held securely, and whereby holding and pulling the said cap with other hand results in tearing said seal into quadrants.

* * * * *